US006663501B2

(12) United States Patent
Chen

(10) Patent No.: US 6,663,501 B2
(45) Date of Patent: Dec. 16, 2003

(54) MACRO-FIBER PROCESS FOR MANUFACTURING A FACE FOR A METAL WOOD GOLF CLUB

(76) Inventor: Charlie C. Chen, 7 Andalucia, Irvine, CA (US) 92614

( * ) Notice: Subject to any disclaimer, the term of this patent is extended or adjusted under 35 U.S.C. 154(b) by 89 days.

(21) Appl. No.: 10/013,580

(22) Filed: Dec. 7, 2001

(65) Prior Publication Data

US 2003/0109328 A1 Jun. 12, 2003

(51) Int. Cl.[7] ..... A63B 53/04

(52) U.S. Cl. ..... 473/324; 473/345; 473/349; 473/409

(58) Field of Search ..... 473/324, 409, 473/345, 349, 350, 347, 348, 282, 290, 291

(56) References Cited

U.S. PATENT DOCUMENTS

| | | | | |
|---|---|---|---|---|
| 4,309,226 | A | * | 1/1982 | Chen |
| 5,024,437 | A | | 6/1991 | Anderson |
| 5,026,520 | A | | 6/1991 | Bhowal et al. |
| 5,094,383 | A | | 3/1992 | Anderson et al. |
| 5,261,663 | A | | 11/1993 | Anderson |
| 5,460,371 | A | | 10/1995 | Takeda |
| 5,485,998 | A | * | 1/1996 | Kobayashi |
| 5,545,271 | A | | 8/1996 | Coulon |
| 5,755,627 | A | * | 5/1998 | Yamazaki |
| 5,848,648 | A | | 12/1998 | Preiss |
| 6,089,070 | A | * | 7/2000 | Hancock |
| 6,200,228 | B1 | | 3/2001 | Takeda |
| 6,277,033 | B1 | | 8/2001 | Krumme et al. |
| 6,299,547 | B1 | | 10/2001 | Kosmatka |

FOREIGN PATENT DOCUMENTS

JP 9-103523 4/1997

OTHER PUBLICATIONS

C.C. Chen et al., "Deformation Characteristics of Ti–6AI–4V Alloy Under Isothermal Forging Conditions", Metallugical Transactions A, (Dec. 12, 1976).

Chen et al., "Practical Considerations For Manufacturing High–Strength Ti–10V–2Fe–3A1," Journal of Metals, p. 33–39, (Dec. 7, 1979).

Chen et al., "High Strength Beta Titanium Alloy Forgings For Aircraft Structural Applications."

Chen, "Recent Advancements in Titanium Near–Net–Shape Technology," Advanced Processing Methods, the Metallurgical Society of AIME, p. 20.

Chen, "Processing–Structuer–Property Relationships in Commercial Titanium Alloys," Fifth International conference of Titanium, (Dec. 7, 1984).

Chen, "An Overview on Titanium Forging Technology," ITA, p. 137–145, (Dec. 7, 1985).

* cited by examiner

*Primary Examiner*—Sebastiano Passaniti
(74) *Attorney, Agent, or Firm*—Gene Scott-Patent Law & Venture Group

(57) ABSTRACT

A near-net shape titanium club face for a metal wood golf head is manufacturing with improved product structure and performance. More specifically, the invention provides a metal wood golf club head face consisting of layers of grain fibering by controllable grain flow along face-orientation and surface contours, similar to composite structures, for improved directional strength, impact strength and toughness, as well as hitting face thickness design flexibility for improved hitting sound and increased coefficient of restitution without sacrificing face performance and durability. The hitting face is made by precision hot-die forging in closed dies through large ($\alpha+\beta$) forge deformation to net or near-net shape from a $\beta$-treated work piece. Alternatively, the process may be applied to aluminum alloys or steels.

16 Claims, 6 Drawing Sheets

MACRO-FIBER PROCESS FOR MANUFACTURING A FACE FOR A METAL WOOD GOLF CLUB

BACKGROUND OF THE INVENTION

1. Field of the Invention

This invention relates generally to golf club head fabrication and more particularly to a method of forging a face for a golf club head and certain configurations of the face.

2. Description of Related Art

Three manufacturing methods are used to produce metal wood golf club heads. Such heads are generally hollow one piece assemblies made-up of a body sealed by a face which is used to strike the golf ball. The first, and most common method uses the metal casting process for the manufacture of the body with a cast or otherwise formed face. This method results in excellent shape for various designs and gives optimum weight distribution for wall thickness variation. However, casting porosity problems often present structural quality concerns particularly for the hitting face. The second method utilizes the common forming and assembling processes using plate and sheet stocks to achieve cost reduction. However, this approach imposes engineering-quality concerns from oxide contamination due to large weld regions, resulting in a tendency toward cracking due to inclusions of contamination and porosity on welding structures of several pieces. This process also suffers from structural discontinuities, non-homogenity, and problems related to dimensional stability & tolerances. The third method uses the forging process, which is capable of refining microstructure and properties from cast and from formed and welded products. It provides excellent product quality and performance, but this method is much more costly.

Manufacturing methods of these parts has evolved so that today most metal wood golf club heads are made with a cast body and forged face. This, apparently offers the most cost-effective manufacturing method, and gives excellent face design flexibility for higher performance. This process uses the casting process to produce a head body with a top or crown, bottom or sole plate and a neck or hostel portion. The forging process produces the hitting face. This has become a very common manufacturing method for producing titanium metal wood golf club heads. The cast-body with forged-face allows the head to be made from a wide range of materials and designs. It provides a high performance hitting face structure in an economic package. This approach avoids the defects often found in the other manufacturing approaches. However, the hitting faces produced by the forging or forming methods have not been optimized to produce superior products. This invention teaches a method for producing such products wherein the metallurgical capability in materials and in processing is able to further improve face performance and increase the degree of design freedom and product durability.

The following art defines the present state of this field:

Anderson, U.S. Pat. No. 5,024,437 describes a golf club head having a main body portion formed by investment casting of material such as stainless steel, beryllium copper, titanium, or aluminum. The face plate of the head is formed of a forged metal such as forged carbon steel, this plate being welded to the face portion of the casting to form an integral assembly therewith. The forged metal faceplate affords a more solid impact and feel to the club which provides better control.

Bhowal et al., U.S. Pat. No. 5,026,520 describes fine grain titanium forgings and a process for refining the grain size of alpha. and .alpha.-.beta. titanium alloys through forging and recrystallization above the alloy's .beta.-transus temperature. Specifically, the method employs an isothermal press in which a billet heated above the alloy's .beta.-transus temperature, forged to produce an elongated, flattened grain structure, is held above the alloy's .beta.-transus temperature for a predetermined time to allow fine grains to nucleate and grow through recrystallization, and then is quenched to arrest grain growth and to establish a fine grained titanium alloy. A second forging step may be employed to attain an aspect ratio of the grains. The fine grained titanium forgings made by this process have a maximum prior .beta.-grain size of 0.5 mm throughout the workpiece.

Anderson et al., U.S. Pat. No. 5,094,383 describes a golf club head having a main body portion formed by an investment casting of material such as stainless steel, beryllium copper, titanium, and aluminum. The face plate of the head is formed of a forged metal, such as forged carbon steel, this plate being welded to the face portion of the casting to form an integral assembly therewith. The forged metal faceplate affords a more solid impact and feel to the club which provides better control. Also, it has very high strength. Preferably, the head consists of cast stainless steel, and the face plate of forged stainless steel, both steels being of the same composition.

Anderson, U.S. Pat. No. 5,261,663 describes a golf club head having a main body portion formed by an investment casting of material such as stainless steel, beryllium copper, titanium, and aluminum. The face plate of the head is formed of a forged metal, such as forged carbon steel, this plate being welded to the face portion of the casting to form an integral assembly therewith. The forged metal face plate affords a more solid impact and feel to the club which provides better control. Also, it has very high strength. Preferably, the head consists of cast stainless steel, and the face plate of forged stainless steel, both steels being of the same composition. Face plate metal is preferably re-distributed toward the toe and heel of the head.

Takeda, U.S. Pat. No. 5,460,371 describes a metallic golf club wood head comprising a substantially planar face member welded to a container-shaped rear shell member having an open front face. A shaft connecting portion 7a is forged integrally with an upper portion of the face member 11a. A cut-out 14a is formed in an upper face of a front side of a rear shell member 12a for accommodating a lower portion of the shaft connecting portion 7a. As a result of this construction the number of structural members is reduced and the strength of the shaft connecting portion 7a is increased. Furthermore, the loft angle can be adjusted when manufacturing the face member 11a for example by forging. Moreover, since it is sufficient for the shaft connecting portion 7a to be formed at the top of the head only, the front side of the head can be lightened and the "sweet area" increased.

Preiss, U.S. Pat. No. 5,848,648 describes an improved process for the preparation and fabrication of horseshoes whereby pure titanium or titanium alloys are processed with the exclusion of contaminating gases such as oxygen, nitrogen and hydrogen. The titanium horseshoes have many advantages over the present state of art such as light weight, higher tensile strength, flexibility, wearing resistance, abrasion resistance, hypoallergenic, workability, formability, friction-free, physiologically inert, and are easily formed and shaped into the desired configuration.

Coulon, U.S. Pat. No. 5,545,271 describes A semi-finished product is taken made of a metastable beta titanium alloy containing oxygen in the range 0.4% to 0.7% by weight, and nitrogen in the range 0.1% to 0.2% by weight (oxygen+nitrogen.ltoreq.0.8%). The product is subjected to solution treatment at a temperature in the range 800.degree. C. to 900.degree. C. It is then cooled very quickly (.gtoreq.200.degree. C. per hour), the part is machined, ageing treatment is applied at a temperature in the range 550.degree. C. to 650.degree. C. for in the range 10 minutes to 2 hours so as to transform half of the beta titanium into alpha prime titanium. The titanium alloy part contains 40% to 60% of beta alloy, the remainder being alpha prime alloy. The part has good mechanical properties, good breaking strength, and a good elastic limit.

Hancock et al., U.S. Pat. No. 6,089,070 describes an improved golf club head and an improved method of manufacturing of a golf club head. More particularly, the invention relates to an improved metal wood golf club head and improved method of manufacturing a metal wood golf club head. The invention provides a metal wood golf club head including a one piece precision hot forged body portion comprising a hosel, a sole and a hitting face. The invention also provides a method of manufacturing a metal wood golf club head including the step of integrally forming a body portion of the club head comprising a hosel, a sole and a hitting face. The body portion of the club head is made by precision hot forging a billet of material, particularly titanium or alloys thereof, or alternatively, aluminium or alloys thereof.

Takeda, U.S. Pat. No. 6,200,228 describes a golf club such as an iron golf club comprising a head body with a cavity formed on the rear surface thereof and a back member securely fitted into the cavity, with the both closely contacted each other. Prior to securing a back member 9 to a cavity 8 formed on the rear surface 7 of the head body 6, the back member 9 is heated to a high temperature. The temperature is set at about 750 degrees centigrade, approximated to standard finishing forging temperature if the member 9 is made of titanium or titanium alloy. As the back member 9 is fitted through deformation processing with the same being heated to the high temperature, the flow stress of the metallic material of the back member 9 can be lowered, thus enhancing ductility thereof. As a result, a front surface 14 and a peripheral surface 15 can be closely contacted by the cavity 8 without gaps, so that the back member 9 can be rigidly secured to the cavity 8. Thus the strength of the head is improved to enable the thickness of the face 4 to be made thinner.

Krumme et al., U.S. Pat. No. 6,277,033 describes a striking face for golf clubs, such as a driver, iron or putter, including zones of the same or different material arranged to create a desired "feel" to the golfer and/or produce a desired effect on the golf ball. For instance, the zones can be arranged to create a variation in mechanical properties across the striking face. The zones can be created by using "pixels" such as round or hexagonal rods arranged with their central axes perpendicular to the striking face. Pixels of a first material such as a shape memory alloy such as superelastic NiTi can be arranged in one or more concentric patterns and the remainder of the striking face can be made up of pixels of a second material such as beta-titanium, martensitic NiTi or stainless steel. The superelastic NiTi pixels can thus create a sweet spot on the striking face of the club.

Kosmatka, U.S. Pat. No. 6,299,547 describes a golf club having a club head with a thin, flexible striking plate for improved energy transfer to a golf ball also has a means for limiting the deflection of the striking plate during high speed impacts with the golf ball. A brace is positioned within the interior of the golf club head a predetermined distance from the striking plate to limit the deflection of the thin, flexible striking plate.

Hancock, 9-103523 describes a method to manufacture metal wood golf club heads that includes formation of a one piece main body consisting of a hosel, sole and club face, formation of the top, and fixation of the top to the main body. The main body and the top part of the club is formed by forging or cold pressing metals, particularly by forging or cold pressing titanium or its alloys, aluminum or its alloys, or aluminum alloy 7075, in particular.

The prior art teaches the use of forging titanium alloys and other metals for producing metal wood club faces, but does not teach a forging method for producing the very thin and super-strong metal faces defined in the present invention. The prior art also fails to teach a face that includes a crown portion or a crown and sole portion for improved durability of the part over long use. The present invention fulfills these needs and provides further related advantages as described in the following summary.

SUMMARY OF THE INVENTION

In the past 10 to 15 years the use of titanium alloys for golf club woods provides basic advantages over other high strength materials, such as stronger, lighter, superior sound, and excellent vibration damping. The wood driver produced in titanium gives the highest strength to weight ratio for further upsizing of head, resulting in increased moment of inertia, larger carry, excellent directionality, longer yardage and larger sweet spot.

The hitting faces produced by forging or forming processes have become increasingly popular over the past five years with the improved flexibility in face materials and design. It is known that basic characteristics of hitting faces often play a major role in the performance and quality of golf club heads, however, no attempt have been made to address the forge-processing with precise metallurgical control to produce the hitting faces with net or near-net shapes, along with grain flow control and refinement. This type of face achieves a higher degree of directional strength, impact strength and toughness, reduced face thickness, superior sound and excellent vibration damping, and a greater coefficient of restitution. The thickness of club faces with a macro-fiber lamella structure can be reduced to as low as 0.055 inches to achieve greater coefficient of restitution, ranging from above 0.80 to as high as 0.88 under test conditions such as specified by the United States Golf Association. The inventive process combines low cost with improved control of grain flow orientation.

In recent years, the application of β-Ti alloys have further enhanced the hitting face properties with excellent strength, toughness, and modulus combinations. It offers superior properties in higher strength and good "hit" feel, as well as an increased degree of design freedom especially when using Ti-6Al-4V, an α+β titanium alloy. From a metallurgical consideration, it is known that fiber processing of alloys along metal flow orientation by large forge-deformation offers a product with structural integrity, greater metallurgical soundness and improved mechanical properties. The process deliberately orients the grains in directions requiring maximum strength and other properties, similar to lamella structures or metal-matrix composite. This produces directional alignment or grain flow for increased directional properties in strength, ductility and resistance to impact and fatigue. However, the process requires a combination of closely controlling metallurgical, processing, operational and design variables.

The following discusses various routes that may be taken in hot die forging to achieve, net, or near net shapes in titanium alloys. Near net refers to the production of a part that requires little, if any further finishing operations. Therefore, it is ready for use directly from the forge.

There are three commercial processing routes commonly used for the manufacture of titanium forgings and each has its merits and weaknesses related to resultant structure and properties. The first is the "alpha+beta prefinish with alpha+beta finish," which is the conventional processing route generally used to provide globular-primary alpha microstructure of the forgings for good strength, ductility, and low cycle fatigue capability. The second type is the "beta prefinish with beta finish" forge processing, particularly designed to improve alloy processability and to improve fracture toughness, controlled creep property and crack growth resistance, resulting from an elongated Widmanstatten or colony alpha structure. The third process is the "beta-prefinish with alpha+beta finish" processing route, which is used to improve ductility and LCF properties from beta-forged components, it balances the properties by producing a mixed equiaxed-elongated alpha structure.

Constrained avenues of thermomechanical processing are generally necessary to achieve the desired balance of strength, toughness, and ductility for producing titanium alloy forgings especially at high strength. The resultant beta-grain size and morphology, the degree of alpha+beta deformation in the two-phase region, the alpha-phase morphology and density have close relationships with the resultant tensile strength, ductility and fracture toughness. From a metallurgical standpoint, by manipulating appropriate hot working above and/or below the beta-transus, the alloy is progressively recrystallized and/or strained to achieve the best end products. Forge processes of β-preforms with extensive alpha+beta deformation may be utilized in order to create extended grain flow and to refine the microstructures to assure the desired properties throughout the forging. Hot-die/isothermal forging is a deformation process during which the forging dies are maintained at the same or a temperature slightly below that of the alloy being deformed. The manufacturing capability for the hot die forging has been commercially demonstrated over a wide range of aerospace structural and engine components for more than 25 years. This technology was developed by the present inventor and co-workers during the 1970's. By hot die forging the influence of die-chilling and material strain hardening can be reduced or eliminated. Thus, alloy forgeability can be maximized and the forging structure and properties can be optimized.

Hot dies decrease the differential between the forging stock and die temperatures, allowing a more uniform flow and refined shape of the forged component to be produced in a given operation, the details of the temperature and the strain path throughout the entire cross section of the forging can be carefully established and controlled. As a result, more refined shape, better material utilization, reduced number of forging operations, and precise control of processing variables achieves a net- or near-net shape, without additional, expensive machining operations. The present invention teaches certain benefits in construction and use which give rise to the objectives described below.

The present invention provides a hitting face of a metal wood golf head produced by a precise metallurgically controlled process. The hitting face is produced by macro-fiber processing of β-preforms to produce a net, or near net-shape titanium face. The hitting face produced by this control of grain flow and metal deformation provides products with excellent directional strength, impact strength and toughness. This hitting face will assemble to a one piece casting comprising a crown, a sole and a hosel to form a high performance metal wood driver.

A primary objective of the present invention is to provide a driver face and method of manufacture of such a face that provides advantages not taught by the prior art.

Another objective is to provide such a face capable of assembly to a driver head housing with little or no further machining or finishing steps.

A further objective is to provide such a face capable of superior control of thickness and with a net thickness below that achieved with prior art processes.

A still further objective is to provide such a face capable of a higher coefficient of restitution.

A still further objective is to provide such a face capable of a longer life and less likelihood of sudden failure.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
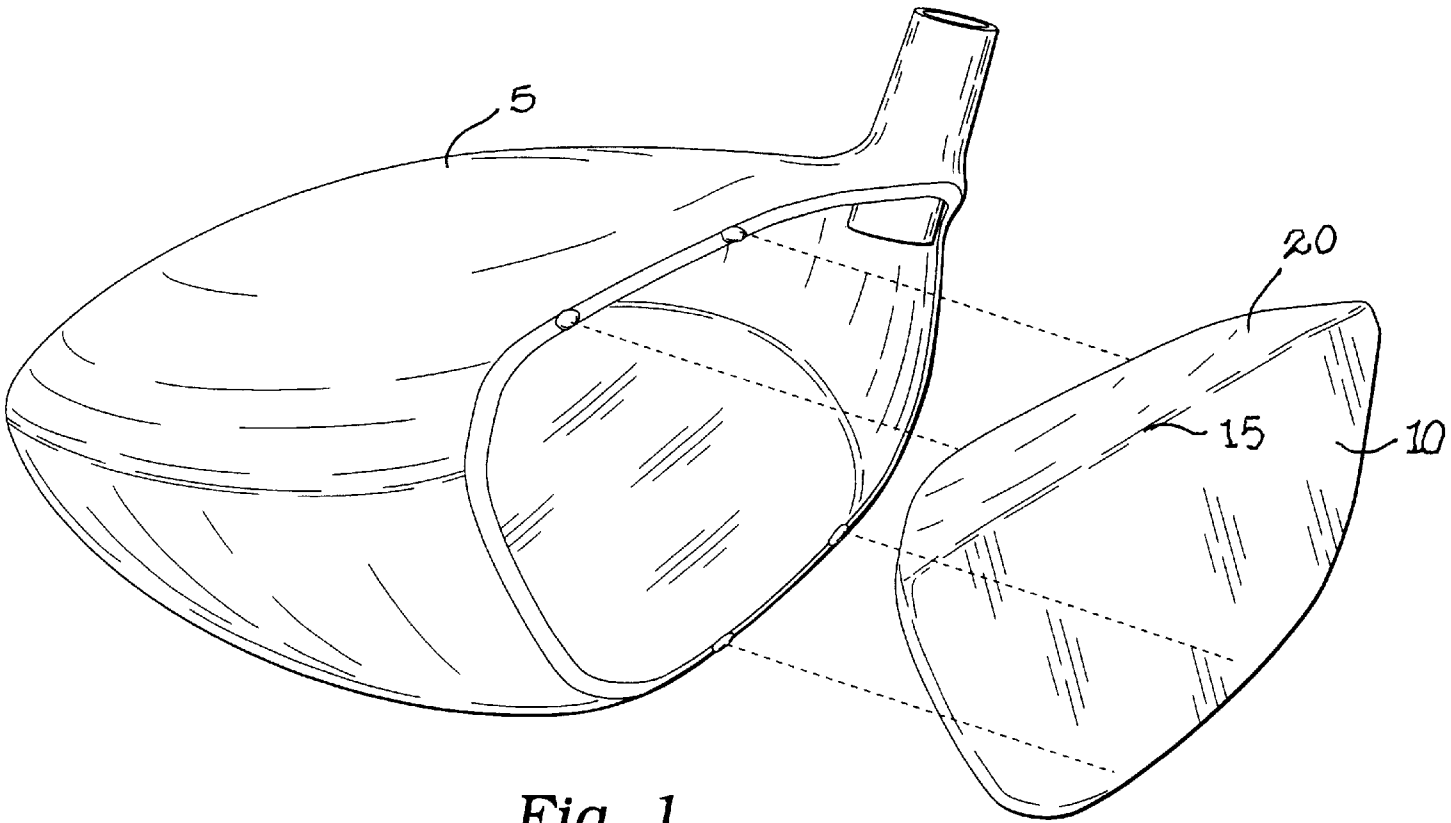
FIG. 1 is a perspective view of a golf club head and face shown exploded, the face representing one embodiment made in accordance with the present invention.

The above described drawing figures illustrate the invention in at least one of its preferred embodiments, which is further defined in detail in the following description.

The invention is a golf club hitting face, which is forged from a pre-processed solid bar, billet, sheet, or plate material using hot-die isothermal forging technology from a pre-processed condition above the β-transus temperature of the alloy. In this specification and the following claims, the phrase "club hitting face" shall mean the portion of the club head that strikes the golf ball as well as portions integral with it but not necessarily in the same plane. To better define these portions the phrases "face element," "face" and "club head face" shall all refer to the portion of the present invention that strikes the golf ball, whereas, "crown outer rim" or "crown element" and "sole outer rim" or "sole element" shall refer to the portions integral with the face element but not necessarily in the same plane. The finished forging operations are plastically deformed in closed dies with the forged alloy heated to below 50% of its melting temperature, or below β-transus temperature. In summary, the processing steps in accordance with this invention are as follows:

(i) Preparation of a workpiece of the forged alloy to a preform shape and size.

(ii) The application of a protective and/or lubricating coating to the preform if necessary.

(iii) Processing of β-preform treatment by heating the workpiece to above β-transus at temperatures below about ($\beta_t$+200° C.).

(iv) Upsetting the β-preform to a proper preform shape if necessary.

(v) Heating of the preform to a desired forging temperatures below $\beta_\tau$ temperature, or below 50% of the melting temperature of the alloy, but generally at or above ($\beta_{t-}$−200° C.).

(vi) Setting up and heating the forging dies to a temperature above ($\beta_t$−400° C.).

(vii) Forging of the preform shape in the closed dies to the final precision shape.

(viii) Repeating sequences (v) thru (vii) if necessary.

(ix) Trimming any flash material from the final as forged shape.

(x) Performing sand-blasting, edge-conditioning and chemical cleaning/etching as required to meet product specifications.

Each of these steps will now be described in further detail as follows:

(i) A raw stock material is prepared from a cylinder bar/billet or regular sheet/plate. The stock material is typically turned or ground to reduce edges and surfaces to appropriate preform dimensions and to provide the desired volume of material for the forging process. The preforms normally include less than 10% greater volume of material than the corresponding finished forging.

(ii) The application of a protective and/or lubricating coating to the bar/billet or sheet/plate preforms; whereby the preforms may be coated with lubricant and/or protective coating prior to heating. Titanium alloy requires a protective coating in order to prevent or to reduce contamination with the atmosphere when the material is heated to a temperature greater than 400° C. However, the coating materials depend largely on the material being forged and are generally ceramic-base or glass-base coating materials.

(iii) The processing of β-preform treatment by heating of the preforms to above β-transus temperatures to form β-grains, generally below about ($\beta_t$+200° C.). This step is normally performed in a furnace with the preforms being heated to above the $\beta_t$ temperature of the alloy, but below about 65% of the melting temperature of the material.

(iv) If the upsetting or conditioning of β-preforms (bar/billet or sheet/plate) into a prefinish-shape is necessary, it suggests that the forge operation be carried out at a temperature below $\beta_t$ and deform for more than 20% of thickness reduction.

(v) The heating of the preforms to the desired forging temperatures below $\beta_t$ temperature, or below 50% of the melting temperature of the material, but generally at or above ($\beta_t$−200° C.). (α+β)-finish forging also enhances large amount of α-phase formation for better toughness. The preforms may be coated with a lubricant and/or protective coating prior to heating.

(vi) The setting-up and heating-up of the impression closed dies to temperatures above ($\beta_t$−400° C.) using hot-die/isothermal forging technology.

(vii) The forging of the preform shape in the closed dies into the final shape. The final forging step uses precision closed die design. This normally consists of two die halves (top and bottom) and the top and bottom dies are controlled by a forging press working the material between dies in the (α+β) field. This (α+β) forge deformation is to plastically flow the materials and also achieve grain refinement and recrystallization for maximum strength. During forging deformation some material is forced out of the dies through designed flash lines to ensure the complete filling of the dies and the flash is later removed in the trimming operation. The finished forged part is then removed from the die. A typical forging cycle is less than about 120 seconds including loading, forging and unloading. Heating time in furnace is generally controlled within one hour.

(viii) Repeat the operational sequence (v) thru (vii) if necessary. When the part tolerance structure is very tight or part is complicated in geometry, this repeat forge sequence may become necessary.

(ix) The trimming of the flash from the final forged shape is carried out upon removal of the part from the final forging die, to remove the excess material or "flash" of the forgings. Trimming occurs by means of a three dimensional tool with a cavity and a punch, and is generally trimmed when the forging is still hot. After trimming the forging is then allowed to cool.

(x) Upon cooling, the forging may then be sand-blasted, ground or tumbled, chemical cleaned or etched to remove the protective/lubricant coating, edges, surface-irregularity, oxide-layers, etc.

Figure 2:
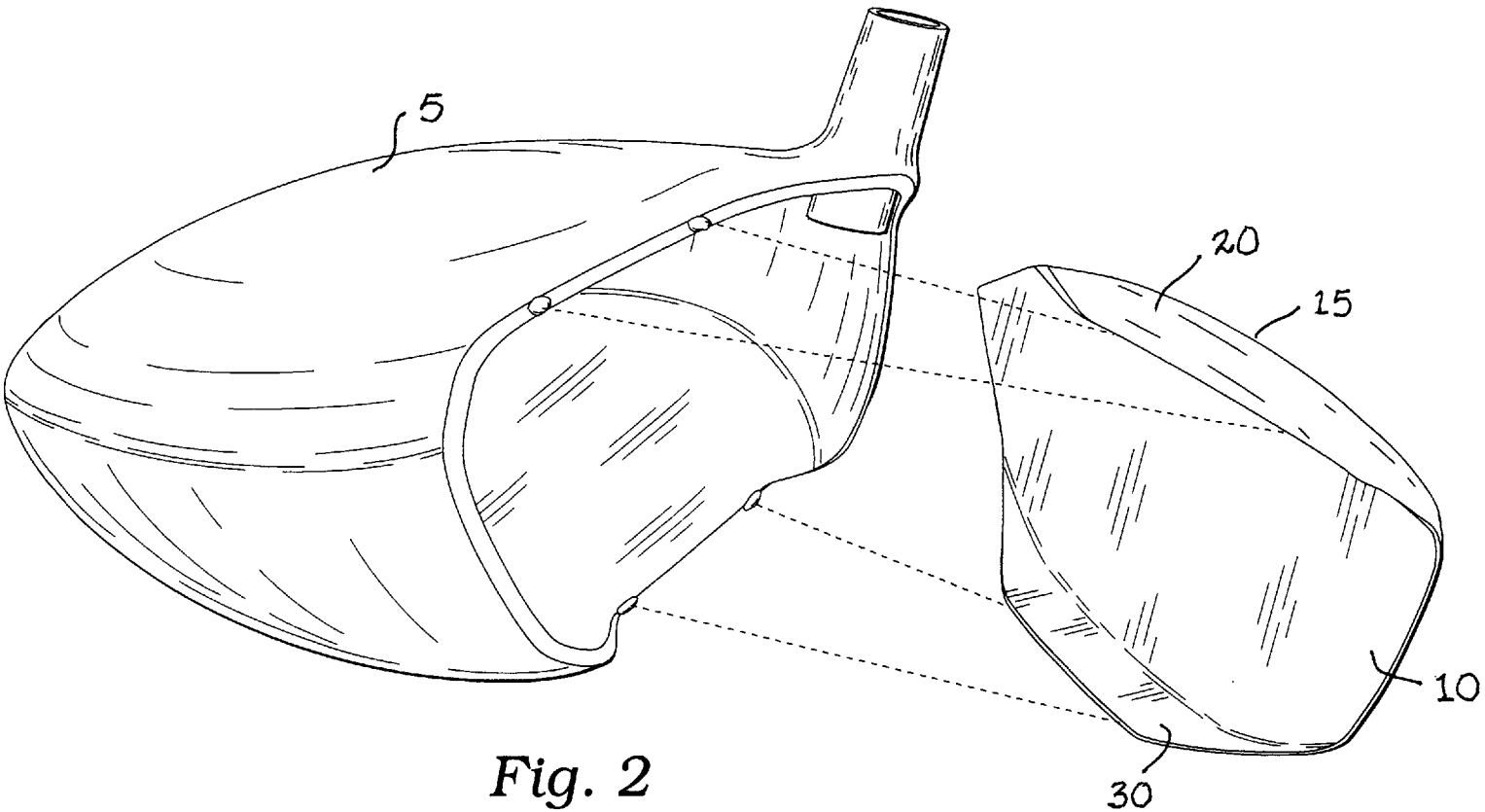
FIG. 2 is a perspective view of a golf club head and face shown exploded with the face rotated toward the viewer to reveal details of its inner surfaces, the face representing a second embodiment made in accordance with the present invention.
Figure 3:
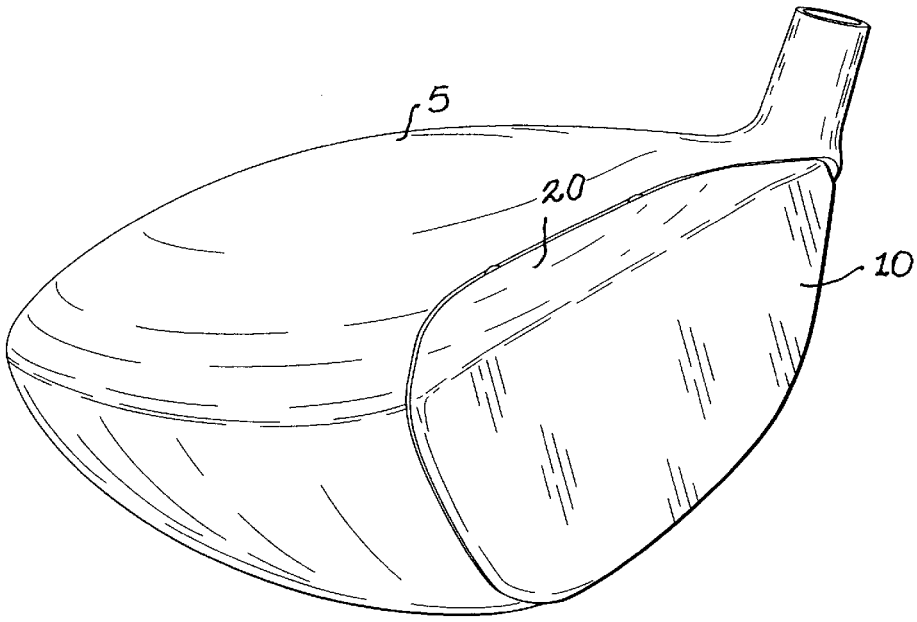
FIG. 3 is a perspective of the golf club head and face of either of the embodiments of FIGS. 1 and 2, as assembled, demonstrating the net-finished face contours.
Figure 4:
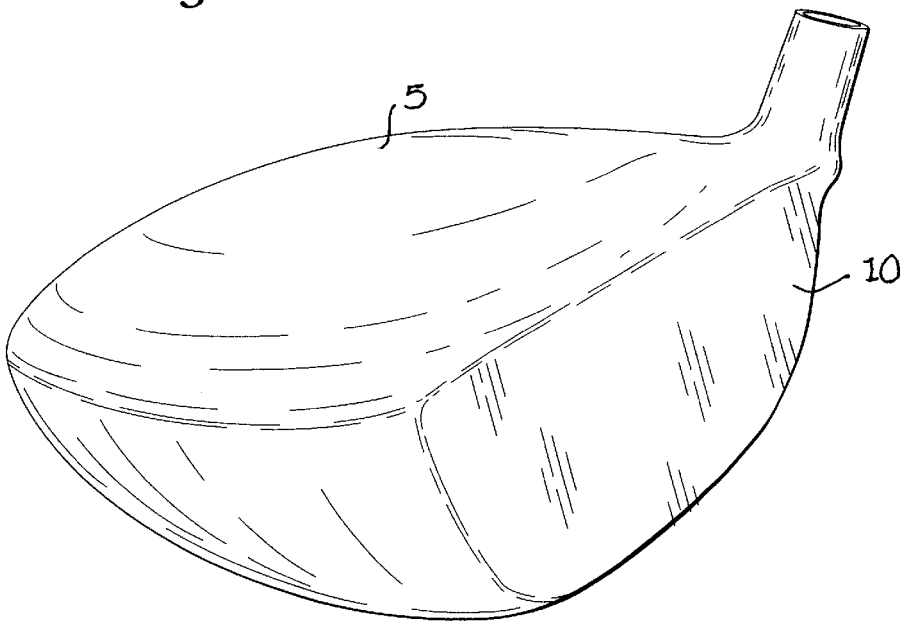
FIG. 4 is similar to FIG. 3 after the golf club head has been welded and finished.
Figure 5:
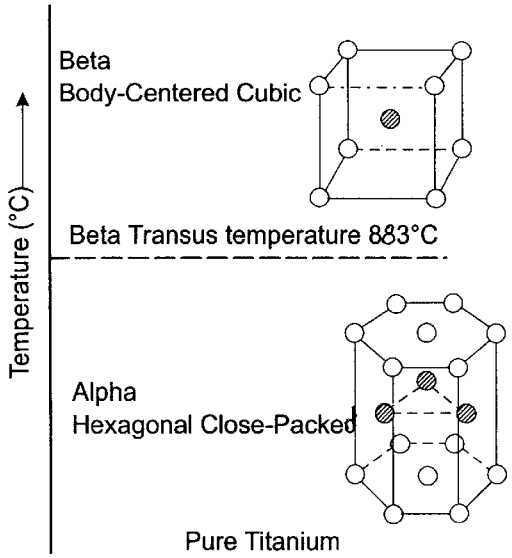
FIG. 5 is a diagram showing the titanium beta phase structure as compared with the alpha phase structure and their relationship to the transus temperature.
Figure 6:
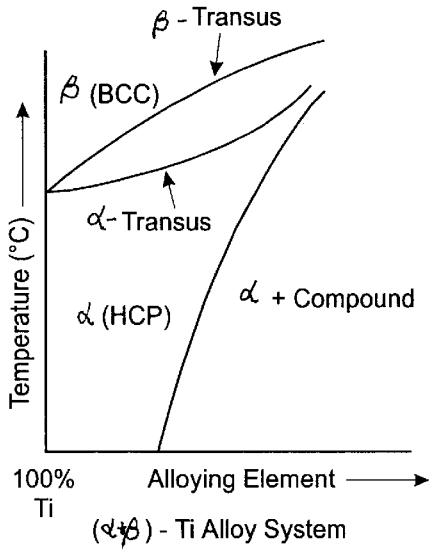
FIGS. 6 and 7 are diagrams showing the effect of alloying on the phase relationship with respect to temperature for (α+β) titanium alloy and β titanium alloy, respectively.
Figure 7:
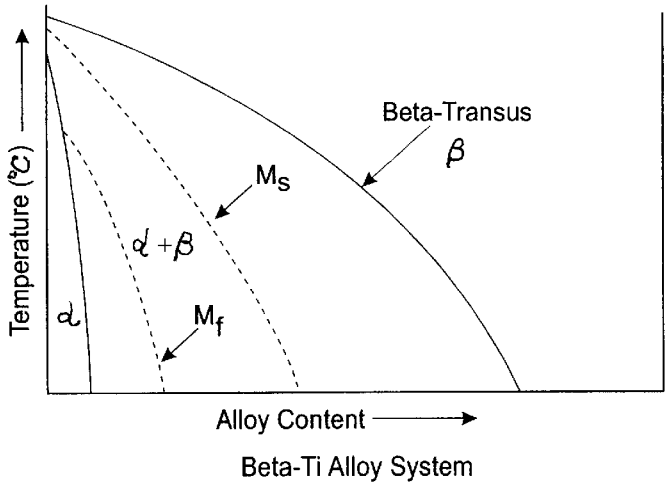
Figure 8A:
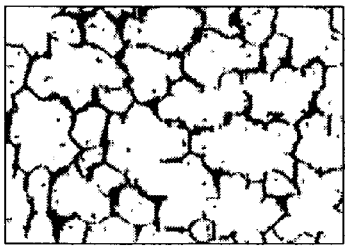
FIGS. 8A–C illustrate a workpiece grain structure in a preform: heated above the beta transus temperature, after initial forging or conditioning and after large α+β forge deformation in hot dies, respectively.
Figure 8B:
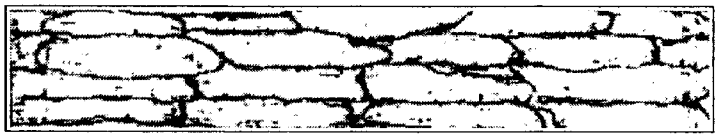
Figure 8C:
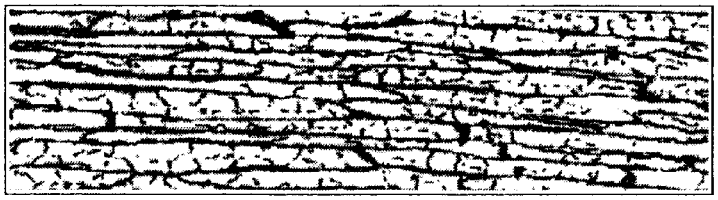
Figure 9:
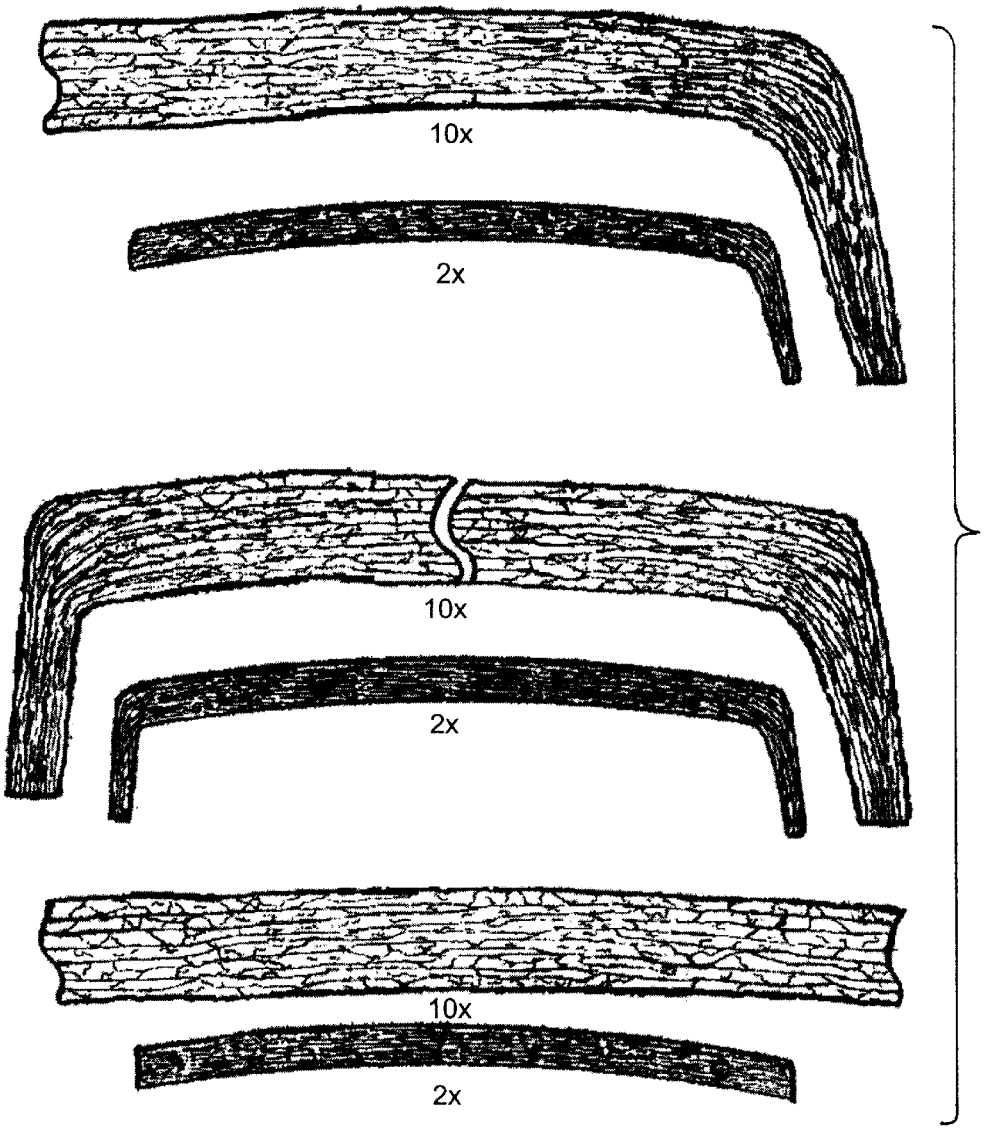
FIG. 9 illustrates typical macro-fiber grain structure in finished golf club head faces in accordance with the invention method, under selected magnification.

Typically a finished golf club face produced by this processing has a weight tolerance of less than ±4% of its nominal specification weight. This precision forging process can provide a wall thickness tolerance within ±5% of nominal specification to a net- or near-net shape without further chemically milling or machining. During the closed die forging this plastic flow results in providing the hitting portion of the club head face 10 with preferential grain flow of processed β-preforms along a face vertical direction, and also the body portion. The material flows under high pressure from the face 10 portion to the crown outer rim 20 and/or the sole outer rim 30 portion. Of particular importance is the junction 15 of the hitting face and the crown. This junction 15 is subject to high stresses during the impact of the club head with a golf ball. The hitting face 10 produced by grain flow fibering structure in an L-shape, shown in FIG. 1 or C-shape design, shown in FIG. 2, posses major structural advantages over other club head designs in which the body portion is made from a number of separate pieces with this junction comprising a welded joint. Common is a 3 or 4 piece formed assembly where discontinuities in the material properties at the joint exist. The present invention produces the hitting face 10 with grain-fiber flow structure along the face orientation, and across the joint of crown 20 (L-shape and C-shape) and sole 30 (C-shape) to net- or near-net shape club face forged as one piece, which results in a continuous material flow at the junction between the hitting face and the crown and/or the sole of the club head.

Furthermore a two piece metal wood head produced by cast-body 5 and forge-face 10 reduces the amount of welding required, reducing greatly the need for grinding and polishing to provide better controlling structural wall thickness on all external surfaces. By eliminating the need for excessive welding of the body portion 5 of the club head, the club head has a more sound construction as compared to an excessive welded head where failure is more likely to happen. Also, the cast-body and forged-face process offers high flexibility for club head designs in mass and thickness distributions. As a result, the distributed mass to a position lower and forward in the club to improve the moment of inertia of the club head becomes feasible.

The present manufacturing process produces net-shape or near-net shape metal club faces with little or no further machining of the faces. The process is carried out at die temperatures within about 400° C. of the forge temperature to reduce or eliminate the large influence of die-chilling and material strain hardening, providing flowability, uniform macro-flow, refined microstructure and properties. The resultant club faces should receive improved impact strength and toughness, giving better damping capacity under impact. Adequate strength and toughness combinations are optimized further by proper heat-treat variables to create precipitation strengthening and to produce alternate alpha particle size and morphology, etc. Forged faces produced by this process sequence apply to various titanium alloys and include various preform shapes in which final ($\alpha+\beta$) forge deformation is required.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method of manufacturing a metal wood golf club head, comprising the steps of: heating a metal workpiece to above the $\beta_t$ temperature of the workpiece thereby creating a $\beta$-preform grain structure therein; heating a set of forming dies to a temperature above $\beta_t$–400° C., for enabling uniform plastic grain flow in the workpiece; heating a forge to a temperature below the $\beta_t$ temperature of the workpiece; and forging the workpiece in the forge to one of a net shape and a near net shape using the forming dies with a closed die ($\alpha+\beta$) finish forging technique, whereby the workpiece achieves a macro-fiber grain flow.

2. The method of claim 1, wherein the workpiece is selected from the group of metal alloys including one of the alloys of titanium, aluminum, steel and stainless steel.

3. The method of claim 1, comprising the further step of shaping the workpiece to form a face element and integral thereto, a crown element; the elements disposed generally at near right angles to form an approximate L-shape.

4. The method of claim 3, comprising the further step of controlling the face element to have a thickness variation of not more than approximately ±5%.

5. The method of claim 3, comprising the further step of controlling the face element to an average thickness in the range of 1.40 mm.

6. The method of claim 1, comprising the further step of shaping the workpiece to form a face element, and integral thereto, a crown element and a sole element, the face element disposed generally at near right angles to the crown and sole elements to form an approximate C-shape.

7. The method of claim 6, comprising the further step of controlling the face element to have a thickness variation of not more than approximately ±5%.

8. The method of claim 6, comprising the further step of controlling the face element to an average thickness in the range of 1.40 mm.

9. A metal wood golf club head, comprising: a metal workpiece forged using a closed die ($\alpha+\beta$) finish forging technique, by heating the workpiece above the $\beta_t$ temperature of the workpiece, thereby creating a $\beta$-preform grain structure therein in a heated set of forming dies heated to a temperature above $\beta_t$–400° C., enabling uniform plastic grain flow in the workpiece; in a forge heated to a temperature below the $\beta_t$ temperature of the workpiece; the forged workpiece having one of a net shape and a near-net shape and a grain fiber commensurate with a macro-fiber grain flow.

10. The metal wood golf club head of claim 9, wherein the workpiece is selected from the group of metal alloys including one of the alloys of: titanium, aluminum, steel and stainless steel.

11. The metal wood golf club head of claim 9, wherein the workpiece comprises a face element and integral thereto, a crown element; the elements disposed generally at near right angles to form an approximate L-shape.

12. The metal wood golf club head of claim 11, wherein the face element has a thickness variation of not more than approximately ±5%.

13. The metal wood golf club head of claim 11, wherein the face element has an average thickness in the range of 1.40 mm.

14. The metal wood golf club head of claim 9, comprising the further step of shaping the workpiece to form a face element, and integral thereto, a spaced apart crown element and sole element, the face element disposed generally at near right angles to the crown and sole elements to form an approximate C-shape.

15. The metal wood golf club head of claim 14, wherein the face element has a thickness variation of not more than approximately ±5%.

16. The metal wood golf club head of claim 14, wherein the face element has an average thickness in the range of 1.40 mm.

* * * * *